US011519253B2

(12) United States Patent
Stephenson et al.

(10) Patent No.: US 11,519,253 B2
(45) Date of Patent: Dec. 6, 2022

(54) SYSTEM AND METHOD TO OPTIMIZE PUMPING

(71) Applicant: HALLIBURTON ENERGY SERVICES, INC., Houston, TX (US)

(72) Inventors: Stanley Vernon Stephenson, Duncan, OK (US); Max Lynn Phillippi, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/274,068

(22) PCT Filed: Dec. 14, 2018

(86) PCT No.: PCT/US2018/065748

§ 371 (c)(1),
(2) Date: Mar. 5, 2021

(87) PCT Pub. No.: WO2020/122945

PCT Pub. Date: Jun. 18, 2020

(65) Prior Publication Data

US 2021/0348491 A1 Nov. 11, 2021

(51) Int. Cl.

| | |
|---|---|
| ***E21B 43/26*** | (2006.01) |
| ***E21B 43/267*** | (2006.01) |
| ***E21B 47/06*** | (2012.01) |
| ***F04B 49/06*** | (2006.01) |
| ***F04B 49/20*** | (2006.01) |

(52) U.S. Cl.

CPC ..... *E21B 43/2607* (2020.05); *E21B 43/267* (2013.01); *E21B 47/06* (2013.01); *F04B 49/065* (2013.01); *F04B 49/20* (2013.01); *F04B 2205/06* (2013.01)

(58) Field of Classification Search

CPC .... E21B 43/2607; E21B 43/267; E21B 47/06; F04B 49/065; F04B 49/20; F04B 2205/06; F04B 13/02; F04B 23/04

See application file for complete search history.

(56) References Cited

U.S. PATENT DOCUMENTS

| | | | | |
|---|---|---|---|---|
| 3,900,043 | A | 8/1975 | Bowen et al. | |
| 6,268,911 | B1 * | 7/2001 | Tubel | E21B 33/1275 356/326 |
| 7,287,540 | B2 | 10/2007 | Hammonds et al. | |
| 7,367,411 | B2 | 5/2008 | Leuchtenberg | |
| 9,256,701 | B2 | 2/2016 | Chen et al. | |
| 9,617,833 | B2 | 4/2017 | Madasu et al. | |
| 9,656,221 | B2 | 5/2017 | Kommareddi et al. | |

(Continued)

OTHER PUBLICATIONS

International Search Report and Written Opinion of PCT Application No. PCT/ US2018/065748, dated Sep. 11, 2019.

*Primary Examiner* — James G Sayre
(74) *Attorney, Agent, or Firm* — Novak Druce Carroll LLP

(57) ABSTRACT

A method is provided which includes injecting a fluid into a wellbore; measuring, by a surface pressure sensor, a surface pressure; and measuring, by a downhole pressure sensor, a downhole pressure. A controller determines a true friction pressure based on a pressure differential between the surface pressure and the downhole pressure. A concentration of one or more components in the fluid is adjusted based on the true friction pressure to lower a total friction pressure loss.

17 Claims, 5 Drawing Sheets

(56) References Cited

U.S. PATENT DOCUMENTS

| | | | | |
|---|---|---|---|---|
| 2008/0185146 | A1 | 8/2008 | Baycroft et al. | |
| 2010/0200239 | A1 | 8/2010 | Aften | |
| 2012/0018148 | A1 | 1/2012 | Bryant et al. | |
| 2015/0075778 | A1 | 3/2015 | Walters et al. | |
| 2016/0273346 | A1* | 9/2016 | Tang | E21B 43/04 |
| 2018/0216438 | A1* | 8/2018 | Sewell | E21B 43/26 |
| 2019/0128111 | A1* | 5/2019 | Pandey | G01V 99/005 |

* cited by examiner

SYSTEM AND METHOD TO OPTIMIZE PUMPING

CROSS-REFERENCE TO RELATED APPLICATIONS

This application is a national stage entry of PCT/US2018/065748 filed Dec. 14, 2018, said application is expressly incorporated herein by reference in its entirety.

FIELD

The present disclosure relates generally to systems and methods to optimize pumping of fluids into a well. In at least one example, the present disclosure relates to systems and methods to minimize friction pressure loss of injected fluid by adjusting the concentration of one or more components of the fluid.

BACKGROUND

In order to produce oil or gas, a well is drilled into a subterranean formation, which may be a reservoir or adjacent to a reservoir. Various types of treatments are commonly performed on a well or subterranean formation. For example, stimulation is a type of treatment performed on a well or subterranean formation to restore or enhance the productivity of oil and gas from the well or subterranean formation. Stimulation treatments can include, for example, hydraulic fracturing.

To fracture a subterranean formation typically requires hundreds of thousands of gallons of fluid to be injected into the well. Further, it is often desirable to fracture at more than one downhole location of a well. Thus, a high volume of fracturing fluid is usually required to treat a well.

BRIEF DESCRIPTION OF THE DRAWINGS

Implementations of the present technology will now be described, by way of example only, with reference to the attached figures, wherein.

DETAILED DESCRIPTION

Figure 1:
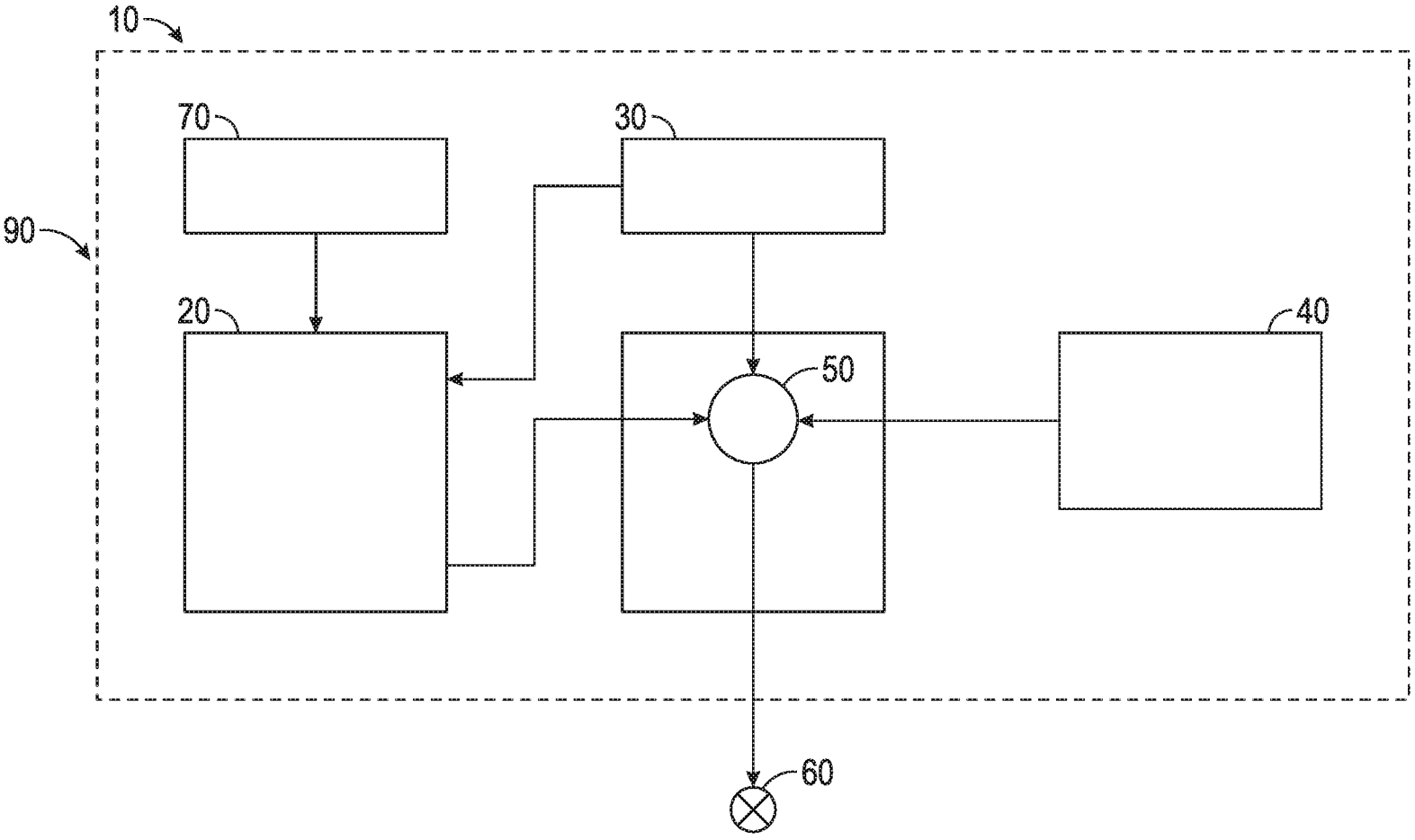
FIG. 1 is a diagram illustrating an example of a fracturing system that may be used in accordance with the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Disclosed herein is a system and method to optimize pumping of fluids into a well. As fluids are injected into the well, for example, for a hydraulic fracturing, the friction pressure can cause wear and tear on pumping equipment and the total fuel required to complete the hydraulic fracturing. Accordingly, minimizing the friction pressure loss minimizes the pressure related wear and tear on the pumping equipment and total fuel required.

Conventionally, concentrations of crosslinkers or friction reducers have been based on either surface testing with assumed downhole conditions or based on the surface pressure measurement. However, the surface pressure measurement changes can be due to pressure changes in the reservoir, friction through perforations, or due to changes induced by varying the concentration of an injected chemical.

As disclosed herein, the system and method include an additive source coupled with an additive pump operable to provide one or more components to a fluid. The fluid is injected into a well by a well pump. A surface pressure sensor measures a surface pressure, or a pressure at or proximate to the surface of the well. A downhole pressure sensor disposed in the well measures a downhole pressure, or a pressure at a predetermined location within the well. In at least one example, multiple downhole pressure sensors can be disposed in the well at varying depths such that pressure at different depths can be measured. As such, the system and method can be used to pinpoint substantially the exact location and/or issue causing the friction pressure loss. The surface pressure sensor and the downhole pressure sensor provide two measurements at different depths in the well such that the surface pressure sensor does not necessarily have to be positioned at the surface or measure a pressure at the surface. In at least one example, the surface pressure sensor and the downhole pressure sensor can be separate, individual sensors. In at least one example, the downhole pressure sensor can be a fiber optic pressure sensor which can measure pressure at a plurality of depths along the fiber optic cable. In some examples, the surface pressure and the downhole pressure sensor can be one fiber optic pressure sensor.

The surface pressure sensor and the downhole pressure sensor are communicatively coupled with a controller which receives the surface pressure and the downhole pressure. A true friction pressure is determined by the controller based on a pressure differential between the surface pressure and the downhole pressure. Based on the true friction pressure, the concentration of one or more of the components in the fluid can be adjusted to lower the total friction pressure loss. For example, the concentration of a friction reducer may be increased and/or a crosslinker may be decreased by activating the additive pump to pump more of the friction reducer and/or less of the crosslinker into the fluid from the additive source. In at least one example, the concentration of the components of the fluid may be increased or decreased as needed. For example, if the concentrations of the friction reducer and/or crosslinker are too high, then the friction pressure loss may increase as well. As such, the system and method adjust the concentration of one or more of the components of the fluid until the friction pressure loss is minimized. Additionally, the system and method determines whether a surface change is caused by the fluid or other factors such as the reservoir.

Figure 2:
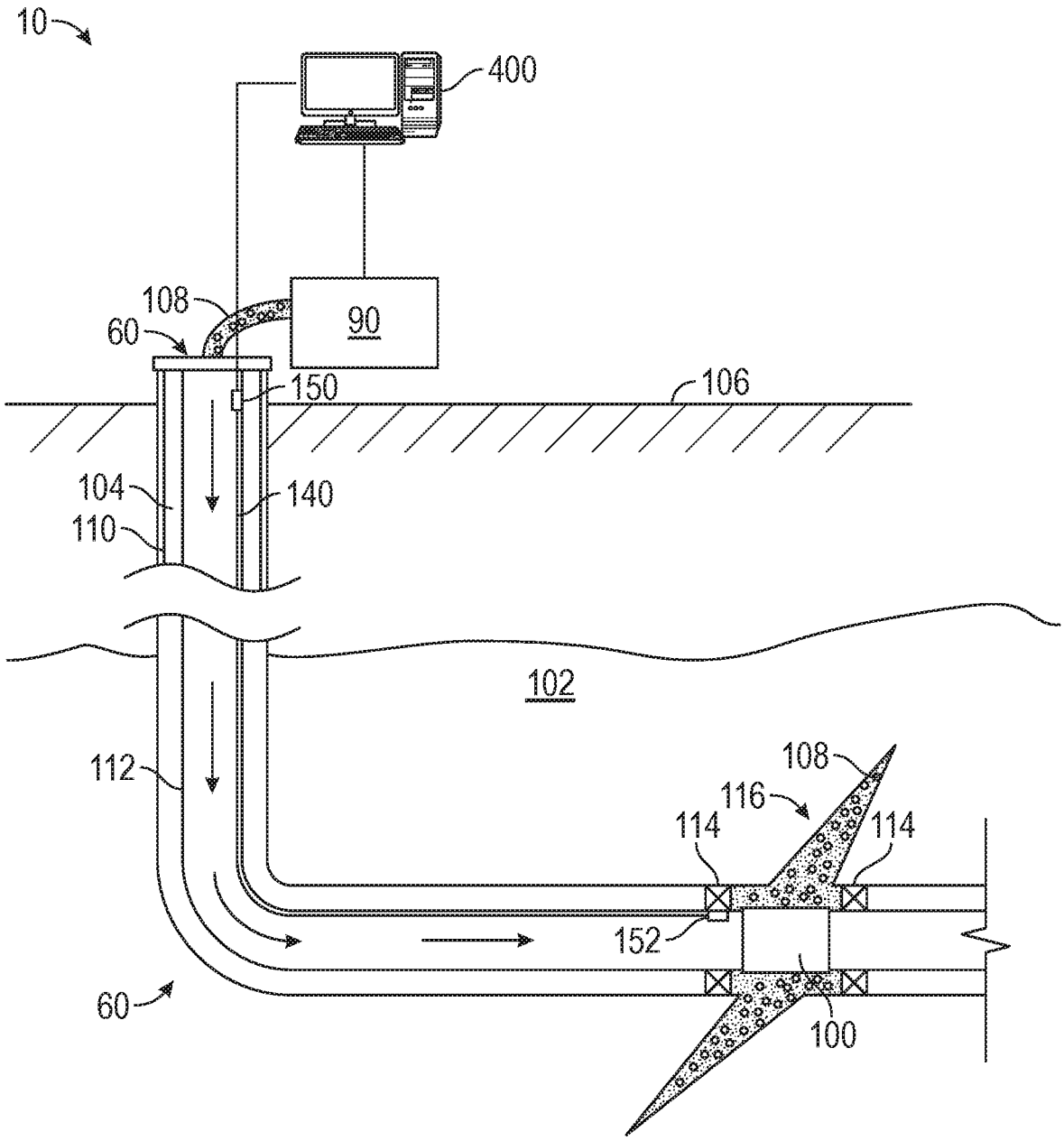
FIG. 2 is a diagram illustrating an example of an environment in which a fracturing operation may be performed.
Figure 3:
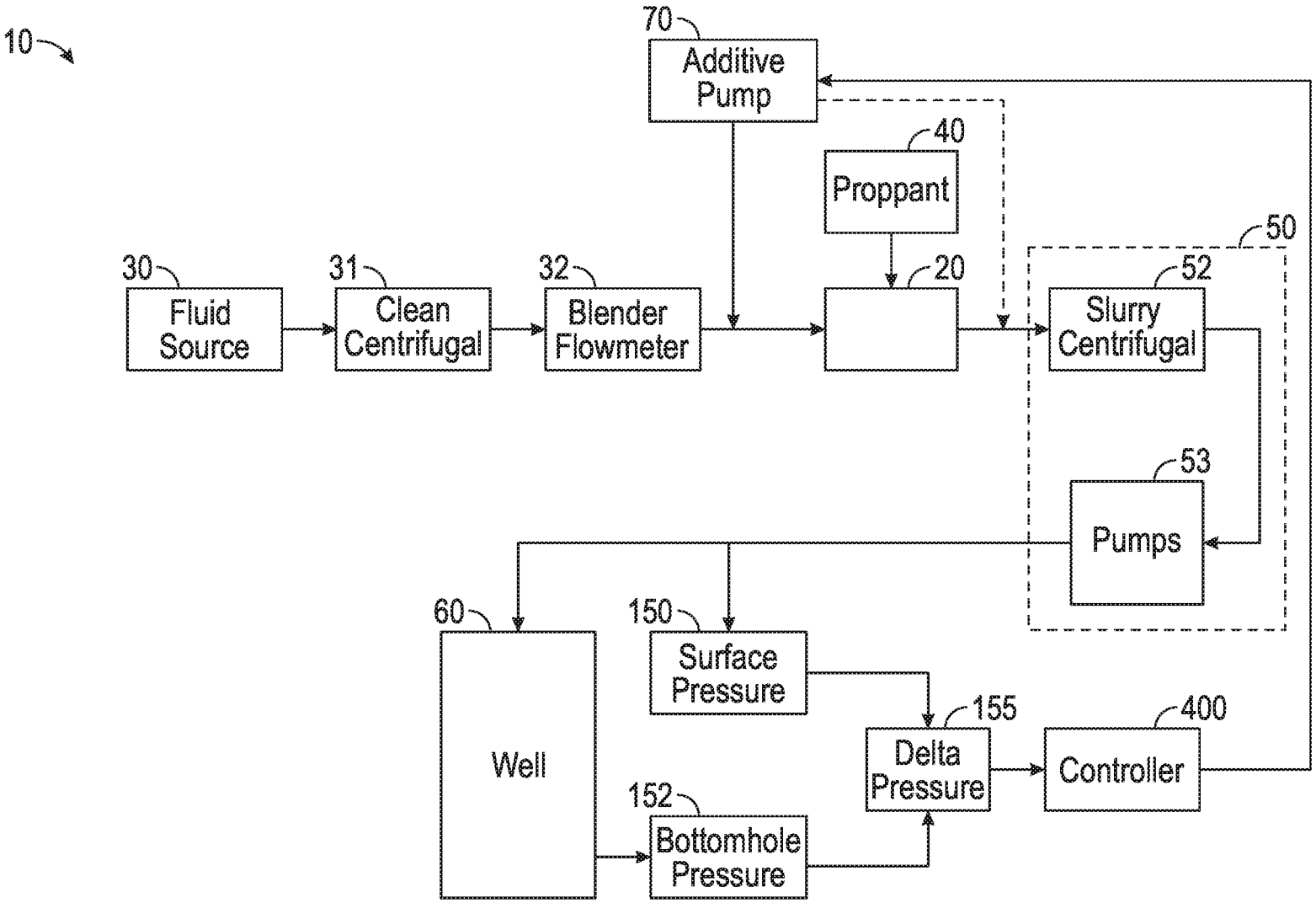
FIG. 3 is a flow diagram illustrating an example of a fracturing system that may be used in accordance with the present disclosure.

An exemplary fracturing system is illustrated in FIGS. 1-3. In this example, the system 10 includes a pumping system 90 which is fluidly coupled with a well 60. The pumping system 90 includes a fracturing fluid producing apparatus 20, a fluid source 30, a proppant source 40, and a pump and blender system 50 and resides at the surface at a well site where the well 60 is located. In certain instances, the fracturing fluid producing apparatus 20 combines a gel pre-cursor with fluid (e.g., liquid or substantially liquid) from fluid source 30, to produce a hydrated fracturing fluid that is used in fracturing the formation, for example, by being pumped through a conveyance 112 and a multi-acting downhole tool 100 (see FIG. 2) when in the open configuration. The hydrated fracturing fluid can be a fluid for ready use in a fracture stimulation treatment of the well 60 or a concentrate to which additional fluid is added prior to use in a fracture stimulation of the well 60. In other examples, the fracturing fluid producing apparatus 20 can be omitted and the fracturing fluid can be sourced directly from the fluid source 30. In at least one example, the fracturing fluid may include water, a hydrocarbon fluid, a polymer gel, foam, air, wet gases and/or other fluids.

The proppant source 40 can include any suitable proppants that can be combined with the fracturing fluid. Proppants can include, for example, sand to keep a hydraulic fracture open, during or following a fracturing treatment. The system may also include additive source 70 that provides one or more additives to alter the properties of the fracturing fluid. The additives can be, for example, gelling agents, weighting agents, friction reducers, and/or cross-linkers. For example, additives 70 can be included to reduce pumping friction pressure, to reduce or eliminate the fluid's reaction to the geological formation in which the well is formed, to operate as surfactants, and/or to serve other functions. The additive source 70 is coupled with an additive pump which pumps the additives from the additive source 70 into the fracturing fluid producing apparatus 20.

The pump and blender system 50 receives the fracturing fluid and combines it with other components, including proppant from the proppant source 40 and/or additional components from the additives 70. The resulting mixture may be pumped down the well 60 and out through the multi-acting downhole tool 100 under a pressure sufficient to create or enhance one or more fractures in a subterranean zone, for example, to stimulate production of fluids from the zone. Notably, in certain instances, the fracturing fluid producing apparatus 20, fluid source 30, and/or proppant source 40 may be equipped with one or more metering devices (not shown) to control the flow of fluids, proppants, and/or other compositions to the pumping and blender system 50. Such metering devices may permit the pumping and blender system 50 to source from one, some or all of the different sources at a given time, and may facilitate the preparation of fracturing fluids using continuous mixing or "on-the-fly" methods. Thus, for example, the pumping and blender system 50 can distribute fracturing fluid and/or proppant through the multi-acting downhole tool 100 to the target subterranean zone.

FIG. 2 illustrates a well 60 performing a fracturing operation in a portion of a subterranean formation of interest 102 surrounding a wellbore 104. The wellbore 104 extends from the surface 106, and the fracturing fluid 108 is applied to a portion of the subterranean formation 102 surrounding the horizontal portion of the wellbore through, for example, the multi-acting downhole tool 100. The tool 100 can include ports, holes, or a sleeve which permits exit of fluid from the conveyance 112. It should be noted that while FIG. 2 generally depicts a land-based operation, those skilled in the art would readily recognize that the principles described herein are equally applicable to operations that employ floating or sea-based platforms and rigs, without departing from the scope of the disclosure. Also, even though FIG. 2 depicts a vertical wellbore, the present disclosure is equally well-suited for use in wellbores having other orientations, including horizontal wellbores, slanted wellbores, multilateral wellbores or the like. The wellbore 104 can include a casing 110 that is cemented or otherwise secured to the wellbore wall. The wellbore 104 can be uncased or include uncased sections. In cased wells, perforations can be formed using shape charges, a perforating gun, hydro-jetting and/or other tools.

The well 60 is shown with a conveyance 112 depending from the surface 106 into the wellbore 104. The conveyance 112 may include coiled tubing, jointed pipe, and/or other structures that allow fluid to flow into the wellbore 104. In at least one example, the conveyance 112 can include the casing 110 of the wellbore 104. The conveyance 112 can include flow control devices that control the flow of fluid from the interior of the conveyance 112 into the subterranean zone 2. As illustrated in FIG. 2, the conveyance 112 and/or the wellbore 104 may include one or more sets of packers 114 that seal the annulus between the conveyance 112 and wellbore 104 to define an interval of the wellbore 104 into which the fracturing fluid 108 will be pumped. FIG. 2 shows two packers 114, one defining an uphole boundary of the interval and one defining the downhole end of the interval. When the fracturing fluid 108 is introduced into wellbore 104 at a sufficient hydraulic pressure, one or more fractures 116 may be created in the subterranean zone 2. The one or more components in the fracturing fluid 108 may enter the fractures 116 where they may remain after the fracturing fluid flows out of the wellbore. These proppant particulates may "prop" fractures 116 such that fluids may flow more freely through the fractures 116.

The pumping system 90, for example the pumping system 90 as illustrated in FIG. 1, is fluidly coupled to the conveyance 112 to pump the fracturing fluid 108 into the wellbore 104 through the conveyance 112. A surface pressure sensor 150 measures a surface pressure, or a pressure at or proximate to the surface of the wellbore 104. A downhole pressure sensor 152 disposed in the wellbore 104 measures a downhole pressure, or a pressure at a predetermined location within the wellbore 104. In at least one example, the downhole pressure sensor 152 can be positioned within the conveyance 112. In some examples, the downhole pressure sensor 152 can be positioned proximate to the fractures 116 such that the downhole pressure sensor 152 measures the downhole pressure at or near the fractures 116. As such, the downhole pressure sensor 152 provides the actual downhole pressure measurements of the fractures 116. In at least one example, multiple downhole pressure sensors 152 can be disposed in the wellbore 104 at varying depths such that pressure at different depths can be measured. In at least one example, the surface pressure sensor 150 and the downhole pressure sensor 152 provide two measurements at different depths in the wellbore 104. For example, the surface pressure sensor 150 may be positioned at a depth downhole and not at the surface, and/or may measure a pressure at the depth downhole and does not measure a pressure at the surface. In at least one example, the surface pressure sensor 150 and the downhole pressure sensor 152 can be separate, individual sensors. In some examples, the downhole pressure sensor 152 can be a fiber optic pressure sensor which can measure pressure at a plurality of depths along the fiber optic cable. In some examples, the surface pressure 150 and the downhole pressure sensor 152 can be one fiber optic pressure sensor.

A controller 400 is communicatively coupled with the pumping system 90, the surface pressure sensor 150, and the downhole pressure sensor 152. In at least one example, the controller 400 is coupled with the additive source 70, for example the additive pump coupled with the additive source 70. The controller 400 receives the surface pressure from the surface pressure sensor 150 and receives the downhole pressure from the downhole pressure sensor 152. The controller 400 determines a true friction pressure based on a pressure differential between the surface pressure and the downhole pressure. The pressure differential is determined based on the actual downhole pressure. In at least one example, the actual downhole pressure is measured by the downhole pressure sensor 152 and received by the controller 400 in real time.

The true friction pressure can be used to determine the actual cause of the surface pressure changes, for example due to the fluid, due to certain concentrations of one or more of the components of the fluid, or other factors such as the reservoir. For example, with crosslinkers, the fluid should crosslink at the fractures 116 to minimize the friction pressure in the conveyance 112. The crosslink time can be affected by wellbore factors such as temperature and the concentration of crosslinker added to the fluid. If only the surface pressure is monitored, then it may not be known whether the change in pressure is due to a difference in crosslink time, temperature, perforation enlargement, changing conditions in fracture, or any combination thereof. Similarly, with friction reducers, if only the surface pressure is monitored, then it may not be known whether the change in pressure is due to a difference in crosslink time, temperature, perforation enlargement, changing conditions in fracture, or any combination thereof. The surface pressure from the surface pressure sensor and the actual downhole pressure from the downhole pressure sensor can be used to determine the true friction pressure and the total friction pressure drop in the conveyance independent of crosslink time, perforation friction, and/or changing conditions in the fracture 116. For example, if the pressure differential between the surface pressure and the downhole pressure is constant, but the total pressure at the surface has decreased, then the pressure differential may be due to a reservoir issue or perforation enlargement.

Based on the true friction pressure, the controller can provide instructions to the pumping system 90, or in at least one example the additive pump and/or the additive source 70, to adjust the concentration of the one or more components from the additive source 70 in the fluid to lower a total friction pressure loss in the conveyance 112. For example, the concentrations of one or more of the components from the additive source 70 can be increased or decreased by adjusting the speed of the additive pump. As such, the pumping speed of the one or more components from the additive source being injected into the fluid is adjusted. In at least one example, the controller can automatically adjust the concentration of the component(s). Accordingly, a user may not be needed, and the system can run substantially autonomously and more efficiently minimize the total friction pressure loss.

FIG. 3 flow diagram illustrating a fracturing system 10, for example fracturing system 10 as illustrated in FIGS. 1-2. A fluid source 30 includes and provides a gel pre-cursor with fluid (e.g., liquid or substantially liquid). The fluid source 30 passes the fluid through a clean centrifugal 31 and a blender flowmeter 32 to the fracturing fluid producing apparatus 20. The blender flowmeter 32 can measure the rate of fluid. In the fracturing fluid producing apparatus 20, one or more components can be added to the fluid from the additive source 70 which is coupled with an additive pump operable to pump the one or more components at a predetermined rate. In at least one example, one or more of the components from the additive source 70 can be added to the fluid before the fluid is received by the fracturing fluid producing apparatus 20 and/or after the fluid is removed from the fracturing fluid producing apparatus 20. In at least one example, the components from the additive source 70 can be crosslinkers and/or friction reducers. Additionally, proppant 40 can be added to the fluid, for example, in the fracturing fluid producing apparatus 20. The proppant 40 can include any suitable proppants that can be combined with the fracturing fluid. Proppants can include, for example, sand to keep a hydraulic fracture open, during or following a fracturing treatment.

The fluid can then be received by the pump and blender system 50. In at least one example, the pump and blender system 50 can include a slurry centrifugal 52 to pump the fluid with the one or more components and proppant to one or more pumps 53 operable to pump the fluid into the well 60. In at least one example, the pumps 53 can be high pressure pumps. The fluid is pumped into the well 60 through a conveyance (for example conveyance 112 and/or casing 110 as illustrated in FIG. 2).

A surface pressure sensor 150 measures a surface pressure, or a pressure at or proximate to the surface of the wellbore 104. A downhole pressure sensor 152 disposed in the wellbore 104 measures a downhole pressure, or a pressure at a predetermined location within the wellbore 104. In at least one example, the downhole pressure sensor 152 can be positioned within the conveyance 112. In some examples, the downhole pressure sensor 152 can be positioned proximate to the fractures 116 such that the downhole pressure sensor 152 measures the downhole pressure at or near the fractures 116. As such, the downhole pressure sensor 152 provides the actual downhole pressure measurements of the fractures 116. In at least one example, multiple downhole pressure sensors 152 can be disposed in the wellbore 104 at varying depths such that pressure at different depths can be measured. In at least one example, the surface pressure sensor 150 and the downhole pressure sensor 152 provide two measurements at different depths in the wellbore 104. For example, the surface pressure sensor 150 may be positioned at a depth downhole and not at the surface, and/or may measure a pressure at the depth downhole and does not measure a pressure at the surface. In at least one example, the surface pressure sensor 150 and the downhole pressure sensor 152 can be separate, individual sensors. In some examples, the downhole pressure sensor 152 can be a fiber optic pressure sensor which can measure pressure at a plurality of depths along the fiber optic cable. In some examples, the surface pressure 150 and the downhole pressure sensor 152 can be one fiber optic pressure sensor.

A controller 400 is communicatively coupled with the pumping system 90, the surface pressure sensor 150, and the downhole pressure sensor 152. In at least one example, the controller 400 is coupled with the additive source 70, for example the additive pump coupled with the additive source 70. The controller 400 receives the surface pressure from the surface pressure sensor 150 and receives the downhole pressure from the downhole pressure sensor 152. The controller 400 determines a true friction pressure based on a pressure differential between the surface pressure and the downhole pressure. The pressure differential is determined based on the actual downhole pressure. In at least one example, the actual downhole pressure is measured by the downhole pressure sensor 152 and received by the controller 400 in real time.

The true friction pressure can be used to determine the actual cause of the friction pressure, for example due to the fluid, due to certain concentrations of one or more of the components of the fluid, or other factors such as the reservoir. Based on the true friction pressure, the controller 400 can provide instructions to the additive pump and/or the additive source 70 to adjust the concentration of the one or more components from the additive source 70 in the fluid to lower a total friction pressure loss in the conveyance 112. For example, the concentrations of one or more of the components from the additive source 70 can be increased or decreased by adjusting the speed of the additive pump. As such, the pumping speed of the one or more components from the additive source being injected into the fluid is adjusted.

Figure 4:
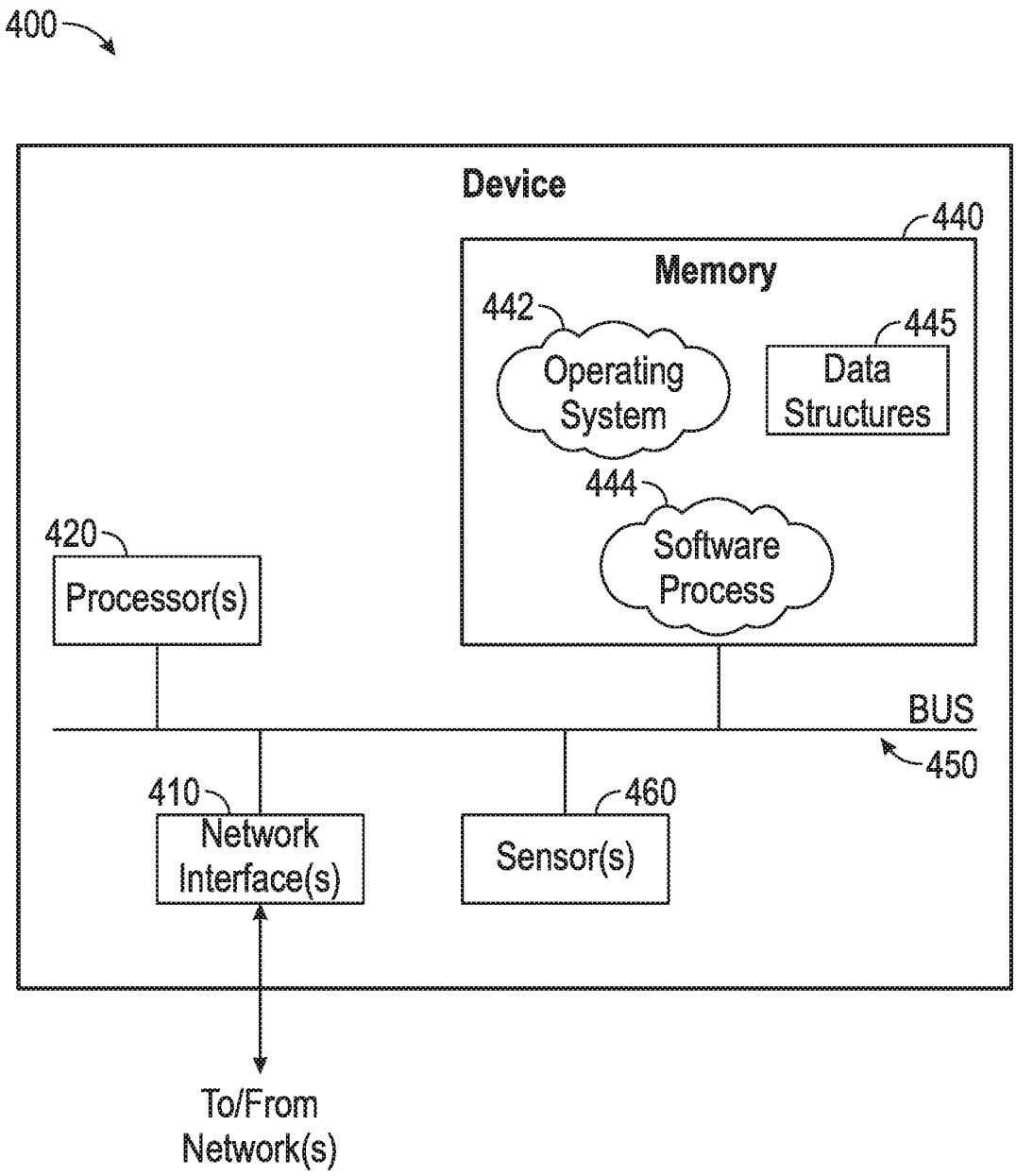
FIG. 4 is a diagram of a controller which may be employed as shown in FIGS. 2 and 3.

FIG. 4 is a block diagram of an exemplary controller 400. Controller 400 is configured to perform processing of data and communicate with the pumping system 90, for example as illustrated in FIGS. 1-3. Additionally, controller 400 can be utilized with the surface pressures sensor 150 and the downhole pressure sensor 152. In operation, controller 400 communicates with one or more of the above-discussed components and may also be configured to communication with remote devices/systems.

As shown, controller 400 includes hardware and software components such as network interfaces 410, at least one processor 420, sensors 460 and a memory 440 interconnected by a system bus 450. Network interface(s) 410 can include mechanical, electrical, and signaling circuitry for communicating data over communication links, which may include wired or wireless communication links. Network interfaces 410 are configured to transmit and/or receive data using a variety of different communication protocols, as will be understood by those skilled in the art.

Processor 420 represents a digital signal processor (e.g., a microprocessor, a microcontroller, or a fixed-logic processor, etc.) configured to execute instructions or logic to perform tasks in a wellbore environment. Processor 420 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 420 typically operates in conjunction with shared or dedicated hardware, including but not limited to, hardware capable of executing software and hardware. For example, processor 420 may include elements or logic adapted to execute software programs and manipulate data structures 445, which may reside in memory 440.

Sensors 460, which may include surface pressure sensor 150 and downhole pressure sensor 152 as disclosed herein, typically operate in conjunction with processor 420 to perform measurements, and can include special-purpose processors, detectors, transmitters, receivers, and the like. In this fashion, sensors 460 may include hardware/software for generating, transmitting, receiving, detection, logging, and/or sampling magnetic fields, seismic activity, and/or acoustic waves, temperature, pressure, or other parameters.

Memory 440 comprises a plurality of storage locations that are addressable by processor 420 for storing software programs and data structures 445 associated with the embodiments described herein. An operating system 442, portions of which may be typically resident in memory 440 and executed by processor 420, functionally organizes the device by, inter alia, invoking operations in support of software processes and/or services 444 executing on controller 400. These software processes and/or services 444 may perform processing of data and communication with controller 400, as described herein. Note that while process/service 444 is shown in centralized memory 440, some examples provide for these processes/services to be operated in a distributed computing network.

It will be apparent to those skilled in the art that other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 444 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 420 or computer readable medium encoded with instructions for execution by processor 420 that, when executed by the processor, are operable to cause the processor to perform the functions described herein.

Figure 5:
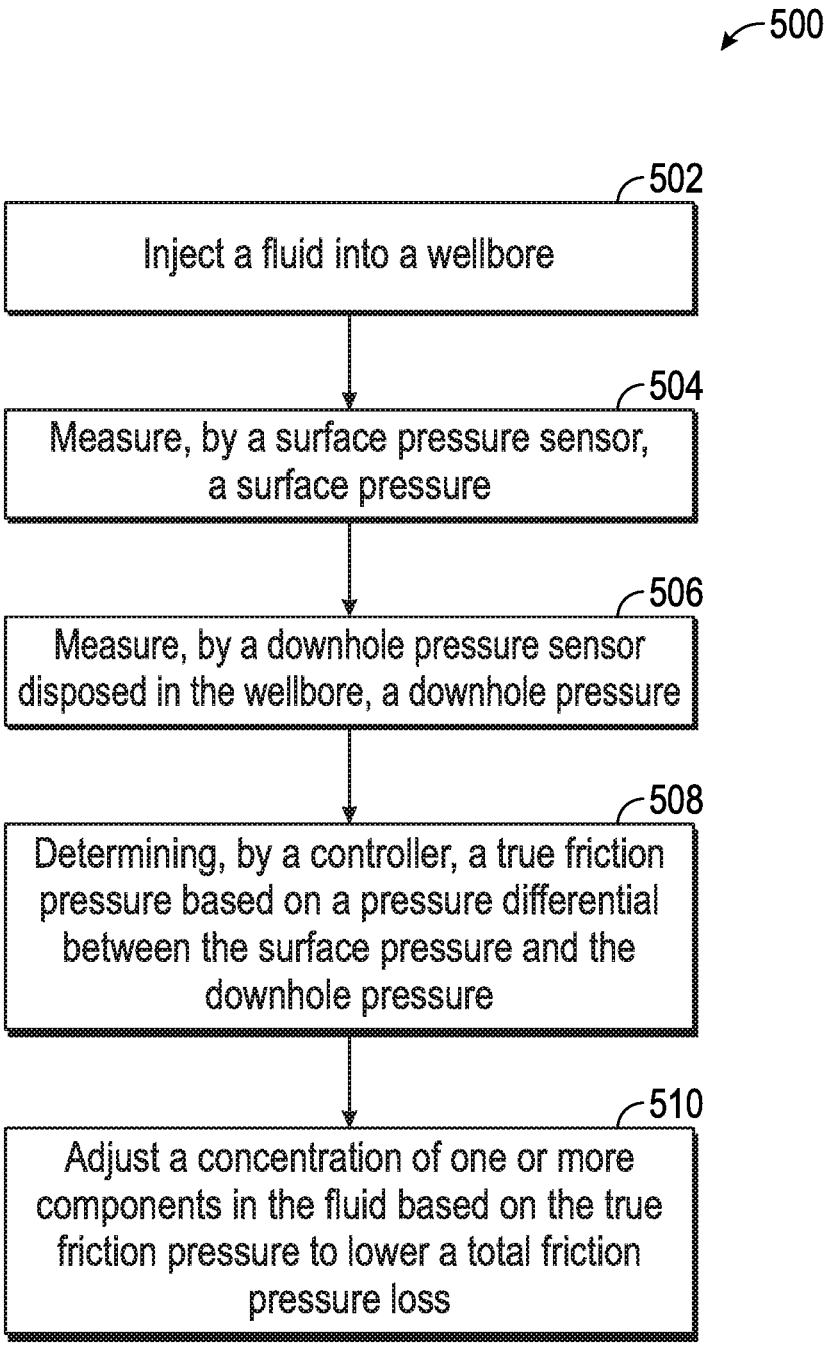
FIG. 5 is a flow chart of a method to optimize pumping.

Referring to FIG. 5, a flowchart is presented in accordance with an example embodiment. The method 500 is provided by way of example, as there are a variety of ways to carry out the method. The method 500 described below can be carried out using the configurations illustrated in FIGS. 1-4, for example, and various elements of these figures are referenced in explaining example method 500. Each block shown in FIG. 5 represents one or more processes, methods or subroutines, carried out in the example method 500. Furthermore, the illustrated order of blocks is illustrative only and the order of the blocks can change according to the present disclosure. Additional blocks may be added or fewer blocks may be utilized, without departing from this disclosure. The example method 700 can begin at block 502.

At block 502, a fluid is injected into the wellbore. The fluid includes one or more components, which can include, for example, at least one of a friction reducer and a cross-linker. The fluid can be a fracturing fluid which can additionally include proppant. The fluid can be injected by a downhole tool into the formation to fracture the formation.

At block 504, a surface pressure sensor measures a surface pressure. In at least one example, the surface pressure sensor can be positioned at the surface. In some examples, the surface pressure sensor can be positioned and disposed within the wellbore at a predetermined depth. In some examples, the surface pressure sensor can be positioned within a conveyance, which can include a casing and/or a tubing.

At block 506, a downhole pressure sensor disposed in the wellbore measures a downhole pressure. The downhole pressure sensor is disposed in the wellbore downhole from the surface pressure sensor. The downhole pressure sensor can be positioned within a conveyance, for example, a casing and/or a tubing. In some examples, the downhole pressure sensor can be positioned proximate to the downhole tool, for example proximate the fractures, such that the downhole pressure sensor measures the downhole pressure at or near the fractures. In at least one example, multiple downhole pressure sensors can be disposed in the wellbore at varying depths such that pressure at different depths can be measured. In at least one example, the surface pressure sensor and the downhole pressure sensor provide two measurements at different depths in the wellbore.

In at least one example, the surface pressure sensor and the downhole pressure sensor can be separate, individual sensors. In some examples, the downhole pressure sensor can be a fiber optic pressure sensor which can measure pressure at a plurality of depths along the fiber optic cable. In some examples, the surface pressure and the downhole pressure sensor can be one fiber optic pressure sensor.

At block 508, a controller determines a true friction pressure based on a pressure differential between the surface pressure and the downhole pressure.

At block 510, a concentration of one or more of the components in the fluid is adjusted based on the true friction pressure to lower a total friction pressure loss, for example within the conveyance or casing. To adjust the concentration of the components, an additive pump can be adjusted to increase or decrease a pumping speed of the one or more components from an additive source. In at least one example, the controller can automatically adjust the concentration of the components. As such, a user is not needed to make the adjustments, and the system can perform more efficiently to minimize the total friction pressure loss and minimize wear and tear of the machinery.

Numerous examples are provided herein to enhance understanding of the present disclosure. A specific set of statements are provided as follows.

Statement 1: A method is disclosed comprising: injecting a fluid into a wellbore; measuring, by a surface pressure sensor, a surface pressure; measuring, by a downhole pressure sensor disposed in the wellbore, a downhole pressure; determining, by a controller, a true friction pressure based on a pressure differential between the surface pressure and the downhole pressure; and adjusting a concentration of one or more components in the fluid based on the true friction pressure to lower a total friction pressure loss.

Statement 2: A method is disclosed according to Statement 1, wherein the one or more components includes at least one of a friction reducer and a crosslinker.

Statement 3: A method is disclosed according to Statements 1 or 2, wherein adjusting the concentration of the one or more components includes: adjusting an additive pump to increase or decrease a pumping speed of the one or more components from an additive source.

Statement 4: A method is disclosed according to any of preceding Statements 1-3, wherein the concentration of the one or more components is adjusted automatically by the controller.

Statement 5: A method is disclosed according to any of preceding Statements 1-4, wherein the downhole pressure sensor is a fiber optic pressure sensor.

Statement 6: A method is disclosed according to any of preceding Statements 1-5, wherein the surface pressures sensor and the downhole pressure sensor are two measurements at different depths in the wellbore provided from a fiber optic pressure sensor.

Statement 7: A method is disclosed according to any of preceding Statements 1-6, wherein the fluid is injected into the wellbore through a conveyance or a casing.

Statement 8: A method is disclosed according to any of preceding Statements 1-7, wherein the downhole pressure is measured proximate to a downhole tool disposed in the wellbore, the method further comprising: injecting, by the downhole tool, the fluid into a formation to fracture the formation.

Statement 9: A system is disclosed comprising: an additive source coupled with an additive pump operable to provide one or more components to a fluid; a well pump operable to pump the fluid into a wellbore; a surface pressure sensor operable to measure a surface pressure; a downhole pressure sensor disposed in the wellbore operable to measure a downhole pressure; a controller coupled with the surface pressure sensor, the downhole pressure sensor, and the additive pump; and a memory storing instructions executable by the controller to: receive the surface pressure from the surface pressure sensor; receive the downhole pressure from the downhole pressure sensor; determine a true friction pressure based on a pressure differential between the surface pressure and the downhole pressure; and adjust the additive pump to adjust a concentration of the one or more components from the additive source in the fluid based on the true friction pressure to lower a total friction pressure loss.

Statement 10: A system is disclosed according to Statement 9, wherein the one or more components includes at least one of a friction reducer and a crosslinker.

Statement 11: A system is disclosed according to Statements 9 or 10, wherein the controller adjusts the additive pump to increase or decrease a pumping speed of the one or more components from the additive source.

Statement 12: A system is disclosed according to any of preceding Statements 9-11, wherein the controller adjusts the additive pump to increase or decrease a pumping speed of the one or more components from the additive source.

Statement 13: A system is disclosed according to any of preceding Statements 9-12, wherein the downhole pressure sensor is a fiber optic pressure sensor.

Statement 14: A system is disclosed according to any of preceding Statements 9-13, wherein the surface pressure sensor and the downhole pressure sensor provide two measurements at different depths in the wellbore provided from a fiber optic pressure sensor.

Statement 15: A system is disclosed according to any of preceding Statements 9-14, wherein the fluid is injected into the wellbore through a conveyance or a casing.

Statement 16: A system is disclosed according to any of preceding Statements 9-15, further comprising a downhole tool disposed in the wellbore operable to inject the fluid into a formation to fracture the formation, wherein the downhole pressure is measured proximate to the downhole tool.

Statement 17: A non-transitory computer readable storage medium is disclosed comprising at least one processor and storing instructions executable by the at least one processor to: receive a surface pressure from a surface pressure sensor; receive a downhole pressure from a downhole pressure sensor; determine a true friction pressure based on a pressure differential between the surface pressure and the downhole pressure; and adjust an additive pump to adjust a concentration of one or more components from an additive source in a fluid based on the true friction pressure to lower a total friction pressure loss.

Statement 18: A non-transitory computer readable storage medium is disclosed according to Statement 17, wherein the one or more components includes at least one of a friction reducer and a crosslinker.

Statement 19: A non-transitory computer readable storage medium is disclosed according to Statements 17 or 18, wherein adjusting the concentration of the one or more components includes instructions executable by the at least one processor to: adjust the additive pump to increase or decrease a pumping speed of the one or more components from the additive source.

Statement 20: A non-transitory computer readable storage medium is disclosed according to any of preceding Statements 17-19, wherein the concentration of the one or more components is adjusted automatically by the controller.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method comprising:

injecting a fluid into a wellbore;

measuring, by a surface pressure sensor, a surface pressure;

measuring, by a downhole pressure sensor disposed in the wellbore, a downhole pressure;

determining, by a controller, a true friction pressure based on a pressure differential between the surface pressure and the downhole pressure;

determining, by the controller, an actual cause of a friction pressure based on the determined true friction pressure; and automatically adjusting, by the controller, a concentration of one or more components in the fluid based on the true friction pressure to lower a total friction pressure loss.

2. The method of claim 1, wherein the one or more components includes at least one of a friction reducer and a crosslinker.

3. The method of claim 1, wherein adjusting the concentration of the one or more components includes:

adjusting an additive pump to increase or decrease a pumping speed of the one or more components from an additive source.

4. The method of claim 1, wherein the downhole pressure sensor is a fiber optic pressure sensor.

5. The method of claim 1, wherein the surface pressure sensor and the downhole pressure sensor are two measurements at different depths in the wellbore provided from a fiber optic pressure sensor.

6. The method of claim 1, wherein the fluid is injected into the wellbore through a conveyance or a casing.

7. The method of claim 1, wherein the downhole pressure is measured proximate to a downhole tool disposed in the wellbore, the method further comprising:

injecting, by the downhole tool, the fluid into a formation to fracture the formation.

8. A system comprising:

an additive source coupled with an additive pump operable to provide one or more components to a fluid;

a well pump operable to pump the fluid into a wellbore;

a surface pressure sensor operable to measure a surface pressure;

a downhole pressure sensor disposed in the wellbore operable to measure a downhole pressure;

a controller coupled with the surface pressure sensor, the downhole pressure sensor, and the additive pump; and a memory storing instructions executable by the controller to:

receive the surface pressure from the surface pressure sensor;

receive the downhole pressure from the downhole pressure sensor;

determine a true friction pressure based on a pressure differential between the surface pressure and the downhole pressure;

determine, by the controller, an actual cause of a friction pressure based on the determined true friction pressure; and automatically adjust, by the controller, the additive pump to adjust a concentration of the one or more components from the additive source in the fluid based on the true friction pressure to lower a total friction pressure loss.

9. The system of claim 8, wherein the one or more components includes at least one of a friction reducer and a crosslinker.

10. The system of claim 8, wherein the controller adjusts the additive pump to increase or decrease a pumping speed of the one or more components from the additive source.

11. The system of claim 8, wherein the downhole pressure sensor is a fiber optic pressure sensor.

12. The system of claim 8, wherein the surface pressure sensor and the downhole pressure sensor provide two measurements at different depths in the wellbore provided from a fiber optic pressure sensor.

13. The system of claim 8, wherein the fluid is injected into the wellbore through a conveyance or a casing.

14. The system of claim 8, further comprising a downhole tool disposed in the wellbore operable to inject the fluid into a formation to fracture the formation, wherein the downhole pressure is measured proximate to the downhole tool.

15. A non-transitory computer readable storage medium comprising at least one processor and storing instructions executable by the at least one processor to:

receive a surface pressure from a surface pressure sensor;

receive a downhole pressure from a downhole pressure sensor;

determine a true friction pressure based on a pressure differential between the surface pressure and the downhole pressure;

determine, by the controller, an actual cause of a friction pressure based on the determined true friction pressure; and automatically adjust, by the controller, an additive pump to adjust a concentration of one or more components from an additive source in a fluid based on the true friction pressure to lower a total friction pressure loss.

16. The non-transitory computer readable storage medium of claim 6, wherein the one or more components includes at least one of a friction reducer and a crosslinker.

17. The non-transitory computer readable storage medium of claim 6, wherein adjusting the concentration of the one or more components includes instructions executable by the at least one processor to:

adjust the additive pump to increase or decrease a pumping speed of the one or more components from the additive source.

* * * * *